US005763809A

United States Patent [19]

Fehrenbach et al.

[11] Patent Number: 5,763,809

[45] Date of Patent: Jun. 9, 1998

[54] DEVICE FOR FASTENING A CARTRIDGE CASE TO A PROJECTILE

[75] Inventors: Karlheinz Fehrenbach, Kussaberg, Germany; Kurt Meng, Zurich; Jakob Burri, Regensdorf, both of Switzerland

[73] Assignee: Oerlikon Contraves Pyrotec AG, Zurich, Switzerland

[21] Appl. No.: 676,492

[22] Filed: Jul. 8, 1996

[30] Foreign Application Priority Data

Jul. 19, 1995 [CH] Switzerland ..... 02 123/95

[51] Int. Cl.[6] ..... F42B 33/00

[52] U.S. Cl. ..... 86/43; 86/1.1; 86/23; 29/508; 29/520

[58] Field of Search ..... 86/1.1, 23, 24, 86/25, 28, 39, 40, 41, 43; 29/505, 508, 520

[56] References Cited

U.S. PATENT DOCUMENTS

| | | | |
|---|---|---|---|
| 2,382,401 | 8/1945 | Dennis . | |
| 2,423,862 | 7/1947 | Vorobik . | |
| 2,571,272 | 10/1951 | Martin | 86/24 |
| 2,956,471 | 10/1960 | McManus | 86/43 |
| 3,948,184 | 4/1976 | Pierre et al. | 102/522 |
| 4,291,609 | 9/1981 | Iivarinen . | |

FOREIGN PATENT DOCUMENTS

| | | | |
|---|---|---|---|
| 0624774 | 11/1994 | European Pat. Off. . | |
| 863809 | 4/1941 | France . | |
| 596563 | 5/1934 | Germany | 86/39 |
| 132407 | 9/1978 | Germany | 29/520 |
| 489288 | 6/1970 | Switzerland . | |
| 2087770 | 6/1982 | United Kingdom | 29/520 |

*Primary Examiner*—Harold J. Tudor
*Attorney, Agent, or Firm*—Greenblum & Bernstein P.L.C.

[57] ABSTRACT

A notching device for fastening a projectile to a cartridge case. The cartridge case may include a shell mouth and a longitudinal axis and the projectile may include an adapter base for insertion into the shell mouth. The adapter base may include at least one circumferential notch inserted into the shell mouth. The notching device may include an elastic ring for exerting a radial compression force on the shell mouth adjacent the at least one circumferential notch to press a portion of the shell mouth into the at least one circumferential notch, and a device for laterally compressing the elastic ring. The lateral compressing device actuating the elastic ring to exert the radial compression force on the shell mouth. The radial compression force may be substantially equal around a circumference of the cartridge case to provide a fluid tight seal. The notching device according to the present invention provides sealed connections between a cartridge case and a projectile and a longer service life than conventional machines of this type.

16 Claims, 3 Drawing Sheets

DEVICE FOR FASTENING A CARTRIDGE CASE TO A PROJECTILE

CROSS REFERENCE OF RELATED APPLICATION

The present application claims priority under 35 U.S.C 119 of Swiss Patent Application No. 02 123/95-2 filed on Jul. 19, 1995.

BACKGROUND OF THE INVENTION

1. Field of the Invention

The present invention relates to a device for fastening a cartridge case to a projectile, e.g., a sub-caliber projectile including an adapter base with at least one circumferential groove. The cartridge case may be connected to the projectile adapter base by notching the cartridge case into the circumferential groove.

2. Discussion of the Background Information

In sub-caliber projectiles, i.e., adapter base projectiles, the actual projectile body may be encased by an adapter base, which may be jettisoned shortly after firing. European Patent Application 0 624 774, for example, discloses an adapter base for a fin-stabilized sub-caliber projectile which includes an adapter base body and an adapter base shell. For the purpose of fastening the cartridge case (or equipping with a cartridge) a circumferential groove may be provided on the adapter base body. The cartridge case may be connected to the adapter base which supports the projectile by being notched at this point. This connection must be sealed so that upon ignition, the required high explosive pressure can build up and so that the powder in the cartridge case is protected from fluid penetration.

Conventional cartridge case notching methods, especially those cartridge cases made of sheet steel, employ devices with radially movable segments to effectuate the relatively high forces required to notch the casing. However, this method may produce leaky spots which require additional sealing means to ensure the objective of powder free from fluid penetration.

SUMMARY OF THE INVENTION

Accordingly, it is an objective of the invention to present a device for fastening a cartridge case to a projectile such that a pressure and fluid sealed connection may be produced between the projectile and the cartridge case. The cartridge case may be made of sheet steel or other suitable material.

According to a feature of the present invention, the fastening device may include a thrust piece for receiving the projectile. The thrust piece may include a cylindrical extension protruding into a bore of a die. An elastic ring may be disposed in the bore in the region of a circumferential groove of the cartridge casing and of a shell mouth. One end face of the elastic ring may be oriented toward the cylindrical extension of the thrust piece and its other end face may rest on a sealing disk positioned against two sliders. The sliders may be guided in the die perpendicular to a longitudinal axis of the cartridge. During notching, the die and the sliders may be pushed toward the thrust piece, thus compressing the elastic ring in the longitudinal direction of the cartridge case and radially expanding the elastic ring in a direction toward the longitudinal axis so that the shell mouth may be pressed into the circumferential groove.

According to another feature of the present invention, the elastic ring may include a material of vulcolan of the adiprene type. The sealing disk may include, for example, a hardened spring steel of a thickness of approximately 0.3 mm. The edge of the inner diameter of the sealing disk oriented toward the elastic ring is rounded.

The present invention is directed to a device for fastening a cartridge case to a projectile. The projectile may include an adapter base with at least one circumferential groove and the cartridge case may be coupled to the adapter base by notching the cartridge case into that at least one circumferential groove. The device may include a thrust piece including a cylindrical extension protruding into a bore of a die provided for receiving the projectile, an elastic ring positioned in the bore adjacent a shell mouth of the cartridge case and the circumferential groove, a first end face of the elastic ring positioned adjacent an end face of the cylindrical extension and a second end face of the elastic ring positioned adjacent at least two sliders. The at least two sliders may be guided into the die perpendicular to a longitudinal axis of the cartridge case and a sealing disk may be positioned between the second end face and the at least two sliders. The device may also include a device for pushing the die and the at least two sliders against the thrust piece. The elastic ring may be compressed by the sealing disk and inwardly deformed in a radial direction so that the shell mouth is pressed into the circumferential groove.

According to another feature of the present invention, the elastic ring may include vulcolan of the adiprene type.

According to another feature of the present invention, the sealing disk may include spring steel and a rounded inner diameter edge oriented toward the elastic ring. Further, the sealing disk may include hardened spring steel with a thickness of approximately 0.3 mm.

According to still another feature of the present invention, the thrust piece and the die may be disposed in a receiving bushing which, along with the die and the sliders, may be pushed against the thrust piece during notching. Further, the thrust piece may be stationary with respect to the device.

According to still another feature of the present invention, the cartridge case may be secured to a base for movement along the longitudinal axis by a resilient insert and a retainer.

The present invention is also directed to a notching device for fastening a projectile to a cartridge case. The cartridge case may include a shell mouth and a longitudinal axis and the projectile may include an adapter base for insertion into the shell mouth. The adapter base may include at least one circumferential notch inserted into the shell mouth. The notching device may include a pressing unit for exerting a radial compression force on the shell mouth adjacent the at least one circumferential notch to press a portion of the shell mouth into the at least one circumferential notch, and a device for laterally compressing the pressing unit. The lateral compressing device actuating the pressing unit to exert the radial compression force on the shell mouth.

According to another feature of the present invention, the pressing unit may include an elastic ring.

According to yet another feature of the present invention, the radial compression force may be substantially equal around a circumference of the cartridge case to provide a fluid tight seal.

According to still another feature of the present invention, the lateral compressing device may further exert a force parallel to the longitudinal axis.

According to still another feature of the present invention, the notching device may further include a receiving bushing for receiving the projectile and cartridge case for notching. The receiving bushing may include a thrust piece, a die, and a device for biasing the thrust piece and the die in opposing directions parallel to the longitudinal axis. The lateral compressing device may further move the die relative to the thrust piece in a direction opposite the biasing device and for move the die relative to the cartridge case.

According to yet another feature of the present invention, the pressing unit may be positioned between the thrust piece and the die. The biasing device may include a compression spring.

According to yet another feature of the present invention, the notching device may also include at least two sliding members for insertion into the die adjacent a lower face of the pressing unit. The at least two sliding members may be inserted into the die until a portion of each of said at least two sliding members are adjacent the cartridge case. The at least two sliding members may be stationary with respect to the die in the longitudinal direction.

According to another feature of the present invention, a sealing disk may be positioned between each of the at least two sliding members and the lower face of the pressing unit. The sealing disk may include an inner diameter including a rounded edge.

According to another feature of the present invention, the notching device may also include a gap formed between an inner diameter of the pressing unit and the cartridge case before the pressing unit is actuated, and the gap may be filled with the pressing unit after the pressing unit is actuated.

According to yet another feature of the present invention, the projectile may include a sub-caliber projectile.

According to yet another feature of the present invention, the notching device may further include a device for securing the cartridge case to a retaining base for positioning the cartridge case within the pressing unit.

According to still another feature of the present invention, the thrust piece may include a centering piece for receiving a tip of the projectile and the die may include a portion for receiving the cartridge case.

The present invention is also directed to a method for fastening a projectile to a cartridge case. The cartridge case may include a shell mouth and the projectile may include an adapter base for insertion into the shell mouth. The adapter base may include at least one circumferential notch inserted into the shell mouth. The method may include exerting a radial compression force on the shell mouth adjacent the at least one circumferential notch to press a portion of the shell mouth into the at least one circumferential notch, and actuating the exerting step by laterally compressing a pressing unit. The lateral compression of the pressing unit actuating the pressing unit to exert the radial compression force on the shell mouth.

The advantages achieved by the present invention include homogeneous, sealed connections between the projectile and the cartridge case. The sealing disk may protect the elastic ring from movements of the sliders. The sealing disk may be formed to include a predetermined thickness and a rounded edge to reduce wear and tear of the elastic ring and thereby increase service life. According to the present amendment, while high forces may be exerted upon the cartridge casing, at least 5000 cartridge equipping cycles may be performed without abrasion of any consequence being detectable on the elastic ring.

Further advantages of the present invention include reduction in expensive tool changing costs. Further, the very low abrasion does not cause the extraction resistance to impair the function of the cartridge.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PREFERRED EMBODIMENTS

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

1. Identification of Reference Elements

Figure 1:
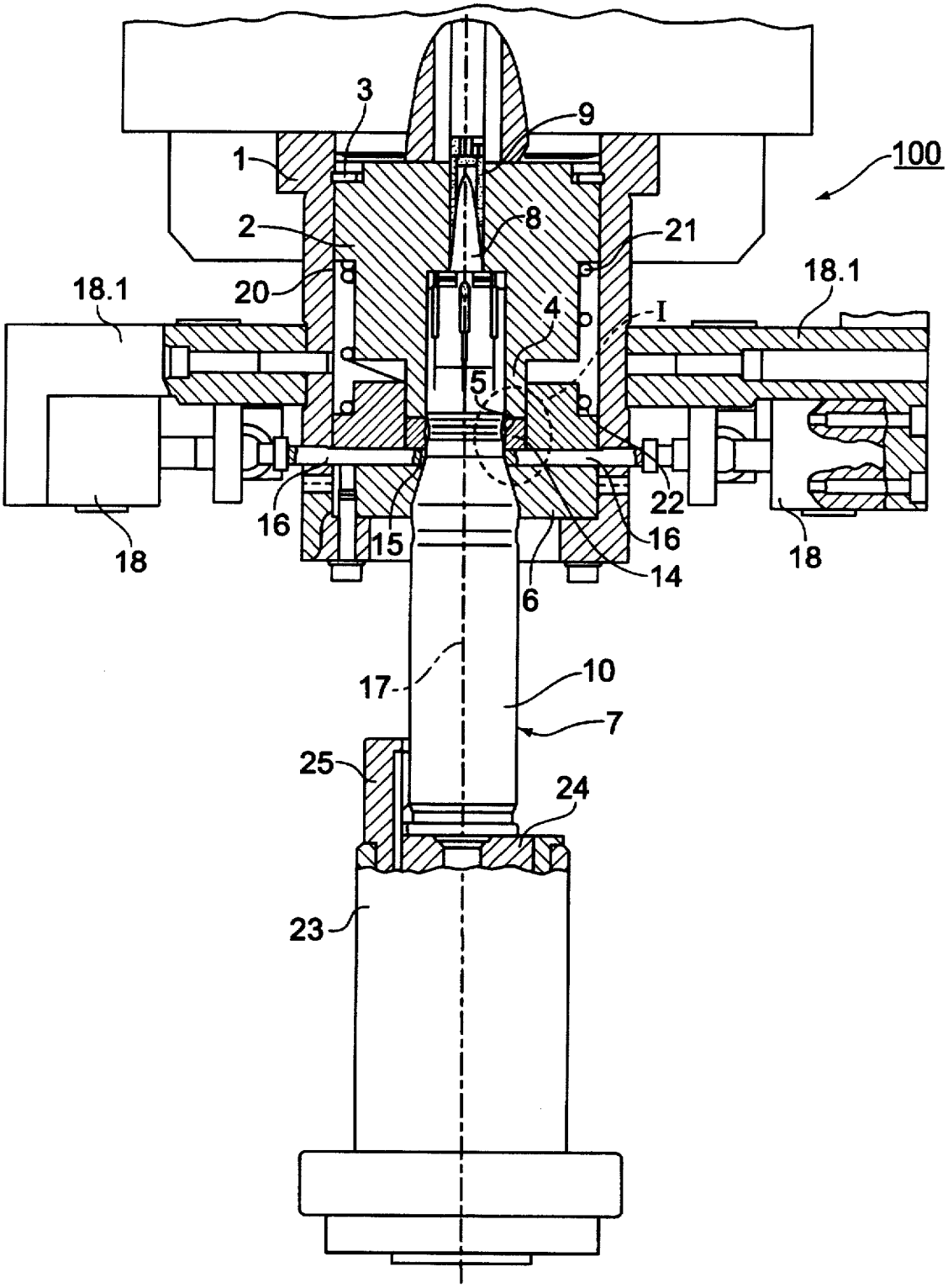
FIG. 1 shows a longitudinal section view of the notching device according to the present invention.
Figure 2:
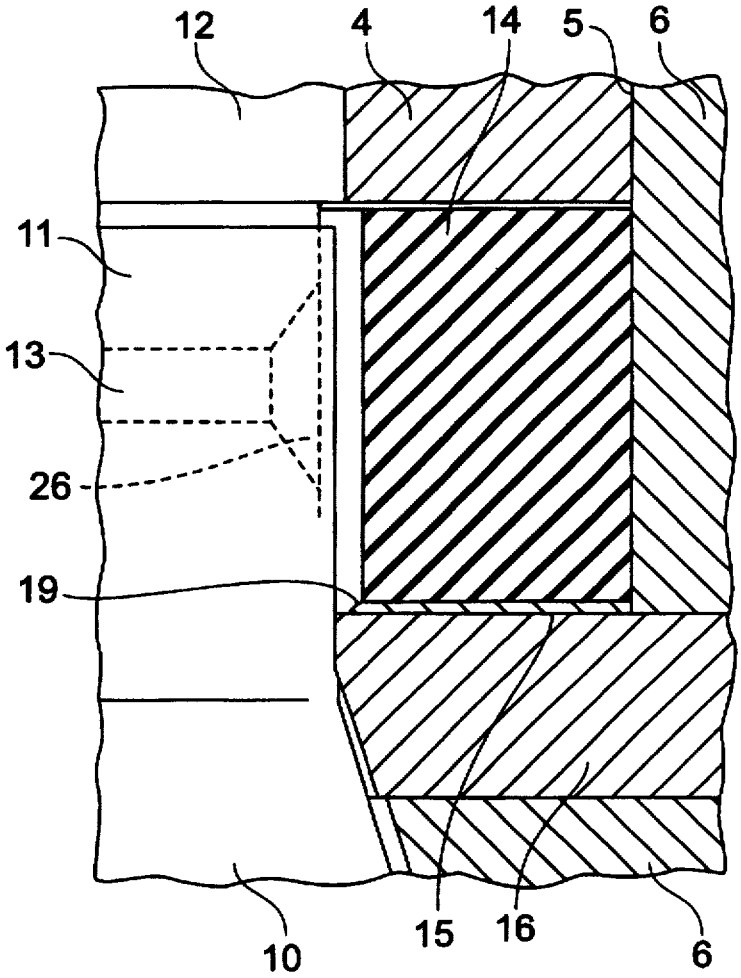
FIG. 2 shows an enlarged view of section I of FIG. 1 showing the present invention with a closed slider in a position prior to notching the cartridge.
Figure 3:
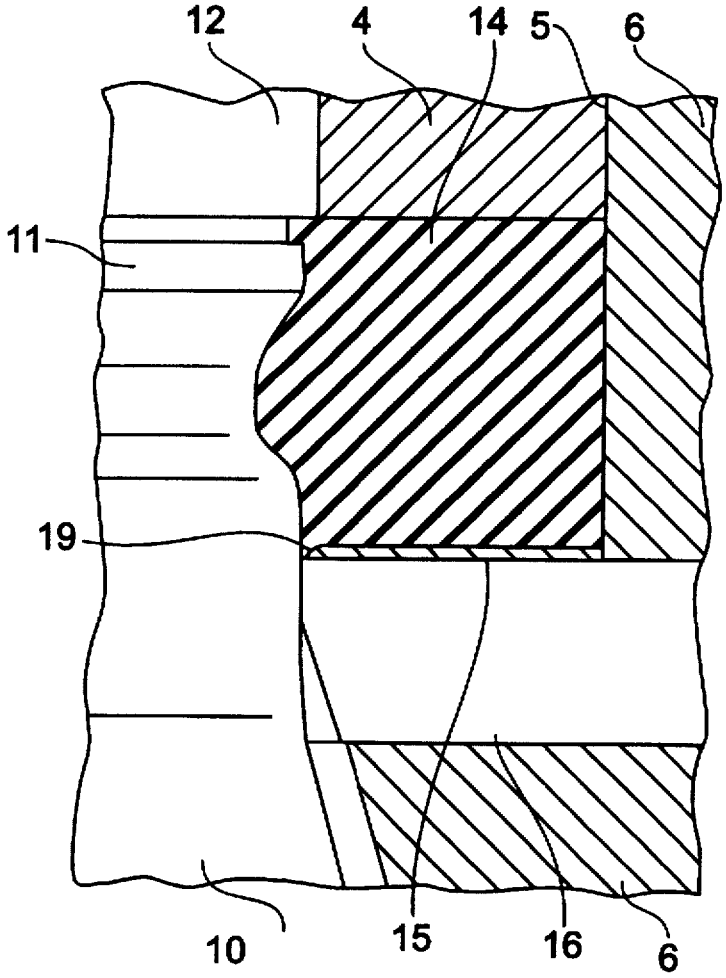
FIG. 3 shows an enlarged view of section I of FIG. 1 showing the present invention in a position after notching the cartridge.

1—Receiving bushing
2—Thrust piece
3—Securing ring
4—Cylindrical extension
5—Bore
6—Die
7—Cartridge
8—Projectile tip
9—Centering device
10—Cartridge case
11—Shell mouth
12—Adapter base
13—Circumferential groove
14—Elastic ring
15—Sealing disk
16—Slider
17—Longitudinal axis
18—Double-acting cylinder
18.1—Carrier
19—Edge
20—Compression spring
21—Shoulder
22—Shoulder
23—Base
24—Resilient insert
25—Retainer
26—Gap
100—Notching device 2. Detailed Description of the Present Invention As shown in FIGS. 1–3, a notching device 100 of the present invention may include a securing ring 3 to coaxially retain a thrust piece 2 within a receiving bushing 1. A die 6 may also be coaxially retained within receiving bushing 1. The thrust piece 2 may include a cylindrical extension 4 to fit within a bore 5 of die 6. During cartridge equipping, thrust piece 2 may receive the projectile of a cartridge 7 such that a projectile tip 8 may be guided into a centering piece 9 and a frustoconical section of cartridge case 10 may be received within die 6. An elastic ring 14 comprised of a material for exerting a radial expansion force substantially equal to a lateral compression force exerted on the material from an external source, e.g., vulcolan of the adiprene type, e.g., adiprene 95 shore A, may be disposed within bore 5 to exert a compression force on the cartridge case 10 of approximately 60 KN+170 KN. As shown in FIG. 2, i.e., an enlarged view of section I in FIG. 1, a circumferential groove 13 of an adapter base 12 of the projectile may be inserted into a shell mouth 11 of cartridge case 10. When the cartridge case 10 is properly seated within the notching device 100, elastic ring 14 may be positioned adjacent the circumferential groove 13 as it is positioned within cartridge case 10. An outer diameter of elastic ring 14 may correspond to a diameter of bore 5. Thus, the outer diameter of elastic ring 14 abuts the wall bore 5. An inner diameter of elastic ring 14 may be greater than diameter of shell mouth 11 or the projectile. Thus, as shown in FIG. 2, a gap 26 may be formed between the inner diameter of elastic ring 14 and shell mouth 11. A first lateral end face of the elastic ring 14 may be oriented adjacent an end face of cylindrical extension 4, while a second lateral end face may rest adjacent a sealing disk 15 and two sliders 16. Sliders 16 may be guided into die 6 in a direction perpendicular to the longitudinal axis 17 of the cartridge 7. The guiding of sliders may be actuated by an actuation means 18, e.g., pneumatically actuated double-acting cylinders 18, fastened to carriers 18.1. Sealing disk 15 may be comprised of, e.g., hardened spring steel with a thickness of 0.3 mm.

An edge 19 may be provided at an inner diameter of sealing disk 15. Edge 19 may be rounded, e.g., from the elastic ring 14 end to the slider 16 end, such that the inner diameter of sealing disk 15 abutting elastic ring 14 may be greater than the inner diameter of sealing disk 15 abutting slider 16 end. A compression spring 20 may be disposed within receiving bushing 1 to provide a constant bias to force apart thrust piece 2 and die 6. Compression spring 20 may abut a shoulder 21 of thrust piece 2 and may abut a shoulder 22 of die 6. On its tail end, cartridge 7 may be secured on a base 23, which may be moved along longitudinal axis 17 by a moving means, e.g., a resilient insert 24 and a retainer 25.

According to the present invention, notching device 100 may be utilized in a manner according to the following discussion of the device.

Base 23 may be lifted by an appropriate device, e.g., a hydraulically actuated ram cylinder (not shown). As base 23 is lifted, cartridge 7 may be pushed through die 6 into thrust piece 2 to place projectile tip 8 within centering piece 9. Sliders 16 may then be pushed radially inward by the two cylinders 18 until they abut cartridge case 10. As shown in FIGS. 2 and 3, sliders 16 slide beyond the inner diameter of sealing disk 15 into the gap produced therebetween. Receiving bushing 1, die 6 and the sliders 16 may be lifted relative to thrust piece 2 by an appropriate lifting means of a notching cylinder (not shown), which may be, e.g., hydraulically actuated. The lifting of receiving bushing 1, die 6 and sliders 16 may be against the bias force of compression spring 20, and force lateral compression of elastic ring 14 via sealing disk 15. As elastic ring 14 may be laterally compressed between the sealing disk 15 and cylindrical extension 4, elastic ring 14 may also be deformed radially inward toward longitudinal axis 17. As the force exerted between sealing disk 15 and cylindrical extension 4 increases, the deformation of elastic ring 14 initially causes elastic ring 14 to radially fill gap 26. As the force between sealing disk 15 and cylindrical extension 4 continues to increase, the radially inward force exerted by elastic ring 14 presses shell mouth 11 into circumferential groove 13 of adapter base 12, as shown in FIG. 3. During the notching process, sealing disk 15 substantially protects elastic ring 14 from direct contact with the motion of sliders 16. However, during the actual notching, elastic ring 14, while filling gap 26, may make very slight egress toward sliders 16 over the rounded edge 19 of sealing disk 15. After notching, the notching cylinder (not shown) and the actuating means 18 are returned to their initial positions so that receiving bushing 1, die 6 and the two sliders 16 may assume their initial position. The ram cylinder may then move back so that notched cartridge 7 may be removed from base 23 and replaced with a new cartridge to be notched.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. Although the invention has been described herein with reference to particular means, materials and embodiments, the invention is not intended to be limited to the particulars disclosed herein; rather, the invention extends to all functionally equivalent structures, methods and uses, such as are within the scope of the appended claims.

What is claimed is:

1. A device for fastening a cartridge case to a projectile, the projectile including an adapter base with at least one circumferential groove and the cartridge case coupled to the adapter base by notching the cartridge case into the at least one circumferential groove, said device comprising:

a thrust piece including a cylindrical extension protruding into a bore of a die provided for receiving the projectile;

an elastic ring positioned in said bore adjacent a shell mouth of the cartridge case and the circumferential groove;

a first end face of said elastic ring positioned adjacent an end face of said cylindrical extension and a second end face of said elastic ring positioned adjacent at least two sliders, wherein said at least two sliders are guided in the die perpendicular to a longitudinal axis of the cartridge case and a sealing disk is positioned between said second end face and said at least two sliders; and means for pushing said die and said at least two sliders against said thrust piece, wherein said elastic ring is compressed by said sealing disk and inwardly deformed in a radial direction so that the shell mouth is pressed into the circumferential groove.

2. The device according to claim 1, said elastic ring comprising vulcolan of the adiprene type.

3. The device according to claim 1, said sealing disk comprising spring steel and a rounded inner diameter edge oriented toward said elastic ring.

4. The device according to claim 3, said sealing disk comprising hardened spring steel with a thickness of approximately 0.3 mm.

5. The device according to claim 1, said thrust piece and said die disposed in a receiving bushing which, along with said die and said sliders, is pushed against said thrust piece during notching.

6. The device according to claim 5, said thrust piece being stationary with respect to said device.

7. The device according to claim 1, the cartridge case is secured to a base for movement along said longitudinal axis by a resilient insert and a retainer.

8. A device for fastening a cartridge case to a projectile, the projectile including an adapter base with at least one circumferential groove and the cartridge case coupled to the adapter base by notching the cartridge case into the at least one circumferential groove, said device comprising:

a thrust piece including a cylindrical extension protruding into a bore of a die provided for receiving the projectile;

an elastic ring positioned in said bore adjacent a shell mouth of the cartridge case and the circumferential groove;

a first end face of said elastic ring positioned adjacent an end face of said cylindrical extension and a second end face of said elastic ring positioned adjacent at least two sliders, wherein said at least two sliders are guided in the die perpendicular to a longitudinal axis of the cartridge case and a sealing disk is positioned between said second end face and said at least two sliders; and a pushing element that pushes said die and said at least two sliders against said thrust piece, wherein said elastic ring is compressed by said sealing disk and inwardly deformed in a radial direction so that the shell mouth is pressed into the circumferential groove.

9. The device according to claim 8, said elastic ring comprising vulcolan of the adiprene type.

10. The device according to claim 8, said sealing disk comprising spring steel and a rounded inner diameter edge oriented toward said elastic ring.

11. The device according to claim 10, said sealing disk comprising hardened spring steel with a thickness of approximately 0.3 mm.

12. The device according to claim 8, said thrust piece and said die disposed in a receiving bushing which, along with said die and said sliders, is pushed against said thrust piece during notching.

13. The device according to claim 5, said thrust piece being stationary with respect to said device.

14. The device according to claim 8, the cartridge case is secured to a base for movement along said longitudinal axis by a resilient insert and a retainer.

15. A notching device for fastening a projectile to a cartridge case, the cartridge case including a shell mouth and a longitudinal axis and the projectile including an adapter base for insertion into the shell mouth, and the adapter base including at least one circumferential notch inserted into the shell mouth, said notching device comprising:

pressing means for exerting a radial compression force on the shell mouth adjacent the at least one circumferential notch to press a portion of the shell mouth into the at least one circumferential notch;

means for laterally compressing said pressing means, said lateral compressing means actuating said pressing means to exert said radial compression force on the shell mouth;

a receiving bushing for receiving the projectile and cartridge case for notching, said receiving bushing comprising a thrust piece, a die, and means for biasing said thrust piece and said die in opposing directions parallel to the longitudinal axis;

said lateral compressing means further for moving said die relative to said thrust piece in a direction opposite said biasing means;

at least two sliding members for insertion into said die adjacent a lower face of said pressing means, means for inserting said at least two sliding members into said die until a portion of each of said at least two sliding members are adjacent the cartridge case, said at least two sliding members being stationary with respect to said die in the longitudinal direction; and a sealing disk positioned between each of said at least two sliding members and said lower face of said pressing means, said sealing disk comprising an inner diameter including a rounded edge.

16. A notching device for fastening a projectile to a cartridge case, the cartridge case including a shell mouth and a longitudinal axis and the projectile including an adapter base for insertion into the shell mouth, and the adapter base including at least one circumferential notch inserted into the shell mouth, said notching device comprising:

a pressing unit that exerts a radial compression force on the shell mouth adjacent the at least one circumferential notch to press a portion of the shell mouth into the at least one circumferential notch;

an element that that laterally compresses said pressing unit, said lateral compressing element actuating said pressing unit to exert said radial compression force on the shell mouth;

a receiving bushing for receiving the projectile and cartridge case for notching, said receiving bushing comprising a thrust piece, a die, and a biasing element that biases said thrust piece and said die in opposing directions parallel to the longitudinal axis;

said lateral compressing element further for moving said die relative to said thrust piece in a direction opposite said biasing element;

at least two sliding members for insertion into said die adjacent a lower face of said pressing unit, a device that inserts said at least two sliding members into said die until a portion of each of said at least two sliding members are adjacent the cartridge case, said at least two sliding members being stationary with respect to said die in the longitudinal direction; and a sealing disk positioned between each of said at least two sliding members and said lower face of said pressing unit, said sealing disk comprising an inner diameter including a rounded edge.

* * * * *